United States Patent [19]

Gibson

[11] Patent Number: 4,612,056

[45] Date of Patent: Sep. 16, 1986

[54] METHOD AND DEVICE FOR PLATFORM ENCRUSTATION ERADICATION

[75] Inventor: James B. Gibson, Placentia, Calif.

[73] Assignee: Chevron Research Company, San Francisco, Calif.

[21] Appl. No.: 676,703

[22] Filed: Nov. 30, 1984

[51] Int. Cl.[4] ..... B08D 7/04

[52] U.S. Cl. ..... 134/6; 119/4; 405/211; 405/216; 15/246

[58] Field of Search ..... 134/42, 4, 6; 119/4; 422/6; 405/216, 211; 15/246

[56] References Cited

U.S. PATENT DOCUMENTS

| | | | |
|---|---|---|---|
| 1,134,881 | 4/1915 | Lockwood | 15/210 B |
| 3,103,103 | 9/1963 | Liddell | 422/6 |
| 3,170,299 | 2/1965 | Clarke | 405/61 |
| 3,505,768 | 4/1970 | Willisford | 422/6 |
| 3,655,445 | 4/1972 | Yamato | 134/42 |
| 3,661,506 | 5/1972 | Watkins | 422/6 |
| 3,719,049 | 5/1973 | Shaw et al. | 405/216 |
| 4,098,955 | 4/1978 | Patridge | 422/6 |
| 4,415,293 | 11/1983 | Engel et al. | 405/211 |
| 4,445,524 | 5/1984 | Angel | 134/113 |

*Primary Examiner*—Andrew H. Metz
*Assistant Examiner*—Sharon T. Cohen
*Attorney, Agent, or Firm*—S. R. LaPaglia; E. J. Keeling; P. L. McGarrigle

[57] ABSTRACT

The present invention is a method and an apparatus for reducing marine growth on an offshore oil platform member. The device uses a buoyant member coupled with a sleeve to scrape the exterior surface of the platform members. The buoyant component floats on the surface of the water and takes advantage of the ocean energy (i.e., the variation of the water's surface height due to the tidal and surge responses) to move the device up and down on the member. The liner and the buoyant member are adjusted for size and buoyancy to ensure that scraping occurs in the areas of the members that are most vulnerable to attachment of marine organisms.

2 Claims, 3 Drawing Figures

METHOD AND DEVICE FOR PLATFORM ENCRUSTATION ERADICATION

FIELD OF INVENTION

The present invention relates to a marine anti-fouling device. Here, the detailed description is directed to a device for keeping marine growth off of the legs or members of an offshore oil platform.

BACKGROUND OF THE INVENTION

The business of oil exploration has reached the point where it may reach and tap the significant oil deposits that are present under the ocean floor. For the drilling and production operations that occur at sea, oil platforms are used to help the men and equipment necessary for this work. These platforms may typically have legs or bracing members that support the upper structures on the sea floor. While these support members keep the upper deck structure a sufficient height above the main water surface, they still are exposed to the development of marine organisms on structural members in the surge zone (i.e., that zone defined by the high and low water marks). Marine crustaceans and other small marine animals will affix themselves to structures such as platform legs and members and then grow to a substantial size. The growth rate of these organism may be up to $\frac{3}{4}$ inch per month and may easily accumulate to a thickness of approximately 14 inches. Of this increased biomass, much of it may be hard growth, which is very difficult to remove.

This marine growth build-up may cause several things to happen, for instance, the member's cross-section may be considerably increased or the member itself may begin to corrode or deteriorate. When the diameter of a piling or member is increased, it presents that much more area to be effected by wave action. This will increase the loads that the support member has to bear and thus makes them more susceptible to damage by storm waves. When the members start to deteriorate due to the biofouling, this compounds a problem.

One common method for removing this material is to have divers simply scrape off the accumulated mass of growth. This, obviously, has its drawbacks. It is expensive for equipment and manpower, the procedure is slow and time consuming, divers may be an added safety risk, etc. Chemical means may also be employed to kill or reduce the attachment of marine organisms to piling surfaces and when carried in a sleeve housing they may provide for a way to protect the pilings without being washed away. U.S. Pat. No. 3,719,049 describes an inflatable sleeve which may carry corrosion resistant materials or rust inhibitors. U.S. Pat. No. 3,661,506 discloses a housing with an inner membrane that carries an anti-foulant and an outer membrane to prevent the dilution of the anti-foulant. However, these methods may introduce toxic biocides into the marine environment or may introduce other possible aquatic contaminants. Cladding is another alternative. A sleeve or winding may be retro-fitted to the pile by wrapping the pile with an external layer (see U.S. Pat. No. 3,655,445). This cladding may simply be a mechanical seal or may be designed to allow the leaching of heavy metal ions (such as copper) into the surrounding area to inhibit marine growth. However, both of these types of cladding may prove to be expensive. Marine growth would still occur so that the wrapped material would have to be changed at some point in time. The cladding with the heavy metal ions would further present a problem of introducing of pollutants and biocides to the environment. In short, no one method may be safe, cheap, and non-toxic.

For the reasons noted above, the purpose of this invention is to create a device that may remove marine encrustation from an offshore platform. It is a further object of this invention to perform this task cheaply, efficiently, and without toxic substances.

SUMMARY OF THE INVENTION

The present invention discloses a method and an apparatus for reducing marine growth on offshore platform members. The invention includes a sleeve, made of low friction material that is positioned around an offshore platform member and a buoyant means to keep the sleeve at the air/water interface. The sleeve and the buoyant means are positioned around the platform member that is susceptible to encrustation by marine growth. The fit between the device and the member is sufficiently large to permit free travel with the rise and fall of the water level, yet close enough to provide frequent sliding contact over the member surface. The resultant constant motion and contact create a scrubbing action that prevents or impedes the attachment and growth of marine organisms.

DETAILED DESCRIPTION OF THE INVENTION

The following invention concerns an apparatus for reducing marine growth by taking advantage of waves, tides and swells.

Figure 1:
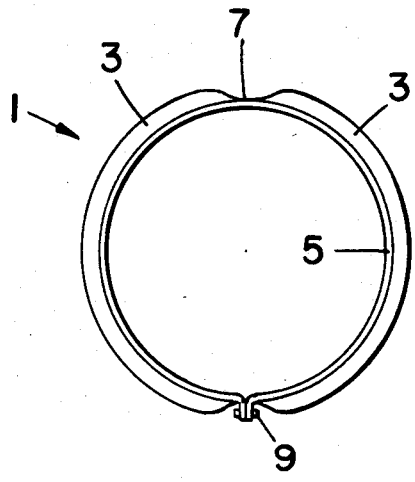
FIG. 1 is a cross-sectional view of a marine platform member cleaning device shown in the closed position.
Figure 2:
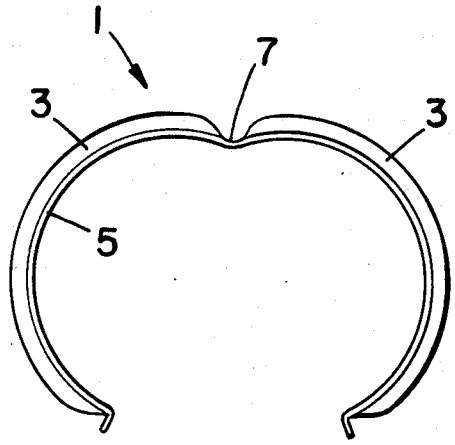
FIG. 2 is also a cross-sectional view of a marine platform member cleaning device shown in the open position.

Referring now to the drawings, FIGS. 1 and 2 show a sleeve device 1 in the open and closed positions that is used for platform encrustation eradication. The device 1 has an inner sleeve 5 which may be made of steel and internally clad with Teflon, polypropylene or other low friction material. The device 1 has an outer jacket 3 placed around the inner sleeve 5. This outer jacket 3 may be constructed of polypropylene or some other buoyant material as this portion of the device 1 functions to keep the inner sleeve 5 floating at the water surface. The amount of bouyancy of the outer jacket 3 and the weight of the inner sleeve 5 may be adjusted so that the device 1 will float with relative ease in the water.

To facilitate operation, the device 1 must be constructed so that it may be placed in a reasonably close fit around a piling 15 or other structural supporting member, such as a cross-brace 17. This may be accomplished by splitting the device 1 at one surface and placing a hinge 7 at the other side of the device 1. Once the device is wrapped around the piling 15 or brace 17 it may be fixed by a clamp 9 at its open end.

Figure 3:
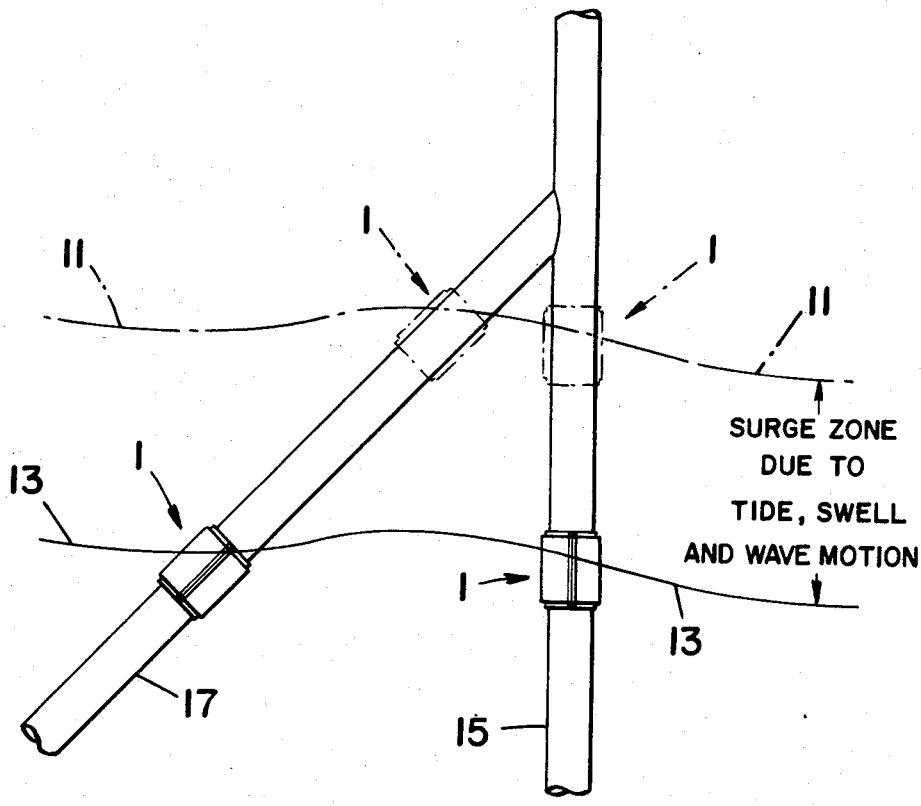
FIG. 3 is a view showing the devices as installed on an offshore platform.

FIG. 3 shows that the device 1 as it is attached to a piling 15 or brace 17 as it generally rests at the water line. It works by riding this water level during tidal and surge periods. If the piling is relatively clean when the device 1 is attached the motion of the device 1 due to tides, swells, and waves, should provide a scraping action that would prevent encrustation from occurring. With a 4-foot long jacket, 8-foot tides, and 4-foot swells, at least 16 vertical feet of the most vulnerable portions of the piling would be constantly agitated. It would not seem likely that a marine organism could establish a foothold under these conditions.

Those platform members that were not vertical, such as member 17, or had attachments or joints near the water line, would require a little more specialized jacket. On angular members the buoyancy could be on one side to orient the jacket for the least friction. Also, multiple jackets could be attached above and below piling sections where cross-bracing interfered with full travel. Furthermore, to increase the cleaning range of the scraping collars, a non-boyant collar could be attached below the buoyant collar by tie rods. This non-buoyant collar could then provide cleaning action below tide water line.

The device 1 should keep each member clean of marine organisms. As far as the device 1 itself goes, there probably would not be very much growth of the jackets. However, if this did occur, it would be much easier and less expensive to remove these devices for cleaning or repair than have a diver scrape the growth from either piling 16 or cross-braces 17. To prevent the attachment of marine organisms onto the device, a surface layer of a material, such as Teflon, could be used to coat the outside of the buoyant jacket. Since the jackets float at the water line, servicing by the boat crews should be relatively inexpensive.

Since many modifications and variations of the present invention are possible within the spirit of this disclosure, it is intended that the embodiment disclosed is only illustrative and not restrictive. For that reason, reference is made to the following claims rather than to the specific description to indicate the scope of this invention.

What is claimed is:

1. A method of reducing marine growth in the splash zone on a platform member, comprising:

placing an outer buoyant jacket around an inner, weighted, low friction sleeve;

slidably positioning said inner sleeve and said outer jacket around a platform member that is susceptible to encrustation by marine growth in a substantially close fit so that the inner sleeve may move along the member in response to tidal and surge action while still scraping the member enough to reduce the attachment of marine organisms; and adjusting the size and buoyancy of the inner sleeve and outer jacket so that the platform member is scraped in the area vulnerable to marine growth.

2. The method as recited in claim 1 where the device comprising the inner sleeve and the outer jacket is divided into at least two sections, said sections being attached by hinges and clasps to facilitate positioning around said members.

* * * * *